US011959285B2

(12) United States Patent
Thorp

(10) Patent No.: US 11,959,285 B2
(45) Date of Patent: Apr. 16, 2024

(54) CLADDING PANEL

(71) Applicant: TECTONIC FACADES LIMITED, Staffordshire (GB)

(72) Inventor: Harvey Richard Thorp, Staffordshire (GB)

(73) Assignee: TECTONIC FACADES LIMITED, Staffordshire (GB)

( * ) Notice: Subject to any disclaimer, the term of this patent is extended or adjusted under 35 U.S.C. 154(b) by 0 days.

(21) Appl. No.: 17/281,822

(22) PCT Filed: Oct. 23, 2019

(86) PCT No.: PCT/GB2019/053019
§ 371 (c)(1),
(2) Date: Mar. 31, 2021

(87) PCT Pub. No.: WO2020/084304
PCT Pub. Date: Apr. 30, 2020

(65) Prior Publication Data

US 2022/0003003 A1 Jan. 6, 2022

(30) Foreign Application Priority Data

Oct. 25, 2018 (GB) ..... 1817381

(51) Int. Cl.
*E04F 13/08* (2006.01)
*E04C 2/04* (2006.01)
*E04F 13/14* (2006.01)

(52) U.S. Cl.
CPC ..... *E04F 13/0862* (2013.01); *E04C 2/041* (2013.01); *E04F 13/147* (2013.01)

(58) Field of Classification Search
CPC .... E04C 2/041; E04F 13/147; E04F 13/0862; E04F 13/0885; E04F 13/0871
(Continued)

(56) References Cited

U.S. PATENT DOCUMENTS 505,659 A * 9/1893 Homan ..... E04B 5/19 52/324
RE17,291 E * 5/1929 Munson ..... E04B 2/14 52/430

(Continued)

FOREIGN PATENT DOCUMENTS

CA 3010868 A1 4/2017
DE 2606610 A1 8/1977

(Continued)

OTHER PUBLICATIONS

Examination Report for GB Application No. 1817381.5, dated Jan. 29, 2021, 5 pages.

(Continued)

*Primary Examiner* — Brian E Glessner
*Assistant Examiner* — Adam G Barlow
(74) *Attorney, Agent, or Firm* — Lee & Hayes P.C.

(57) ABSTRACT

A cladding panel and a method of forming a cladding panel. The panel comprises a plurality of facing building members mounted on a backing of settable material. The facing building members are mounted in rows which are usually aligned horizontally in use, with settable material located in joints between adjacent building members in the rows, and settable material located in joints between neighbouring rows of facing building members. The joints between adjacent facing building members in a row are not aligned with the joints between adjacent facing building members in neighbouring rows of facing building members. The facing building members have front faces and a rear side, with recesses in the rear side of at least some of the facing building members in each row. The recesses extend part way into the facing building member and receive settable material. The recesses in facing building members in neighbouring rows are aligned such that one or more columns of (Continued)

settable material in the recesses are provided extending perpendicularly to the rows of facing building members.

20 Claims, 26 Drawing Sheets

(58) Field of Classification Search
USPC ..... 52/315, 384
See application file for complete search history.

(56) References Cited

U.S. PATENT DOCUMENTS 1,829,435 A * 10/1931 Barnhart ..... E04B 2/02 52/561
2,027,133 A * 1/1936 Weinstein ..... E04D 3/405 52/60
3,233,380 A 2/1966 Rosenfeld
3,740,911 A * 6/1973 O'Leary ..... E04F 13/0862 52/391
4,478,021 A * 10/1984 Person ..... E04C 1/41 52/375
4,809,470 A * 3/1989 Bauer ..... E04F 13/0801 52/592.1
5,373,676 A * 12/1994 Francis ..... E04F 13/0862 52/387
5,501,049 A * 3/1996 Francis ..... E04F 13/0862 52/387
5,959,992 A * 9/1999 Benayoun ..... H04L 12/5601 370/395.6
6,086,067 A * 7/2000 Benoit ..... A63H 33/044 446/109
6,164,037 A * 12/2000 Passeno ..... B28B 19/0061 52/749.11
6,258,041 B1 * 7/2001 Pitesky ..... A61B 5/441 600/556
7,121,051 B2 * 10/2006 Hunsaker ..... E04F 13/0862 52/387
7,694,485 B1 * 4/2010 Siener ..... E04B 2/18 52/592.6
7,806,038 B2 * 10/2010 Duke ..... F41H 5/04 89/36.01
10,458,092 B1 * 10/2019 Correia ..... E02D 29/0266
2003/0213212 A1 * 11/2003 Passeno ..... E04F 13/0862 52/387
2004/0048042 A1 * 3/2004 Yamanashi ..... E04F 13/147 428/143
2004/0182026 A1 * 9/2004 Clarke ..... B28B 7/0073 52/311.1
2009/0126301 A1 * 5/2009 Brown ..... B44F 9/04 52/747.12
2010/0107531 A1 * 5/2010 Hunsaker ..... E04F 13/147 52/745.19
2010/0107534 A1 * 5/2010 Scott ..... E04G 21/185 52/389
2012/0266554 A1 * 10/2012 Fifield ..... E04F 13/0875 52/302.1
2014/0083033 A1 * 3/2014 McIntosh ..... E04F 13/0885 52/302.1
2015/0068149 A1 * 3/2015 Huff ..... E04F 13/22 52/699
2015/0292206 A1 * 10/2015 Frederickx ..... E04C 1/00 52/604
2017/0274556 A1 * 9/2017 Gardiner ..... E04C 2/041
2018/0243956 A1 * 8/2018 Salenius ..... B29C 44/1228
2019/0292792 A1 * 9/2019 Diercks ..... E04F 13/0871
2021/0363754 A1 * 11/2021 Thorp ..... E04C 2/06
2022/0064941 A1 * 3/2022 Bowers ..... E04B 2/18

FOREIGN PATENT DOCUMENTS

EP 0119338 A1 9/1984
EP 1825957 A2 8/2007
EP 2308645 A1 4/2011
GB 986688 A 3/1965
GB 1253621 A 11/1971
GB 1574935 9/1980
GB 1574935 A * 9/1980 ..... B28B 19/0053
GB 2573501 A 11/2019
KR 20100015230 A 2/2010
WO 2011/085447 A1 7/2011

OTHER PUBLICATIONS

"Free Online Education Presents > 2017 AC1 Spring Convention, Detroit, MI > UHPC—Innovations for Broad Applicaton", American Concrete Institute, [online], available from: https:///www.concrete.org/education/freewebsessions/completelisting.aspx , [Accessed Aug. 13, 2021].
The Great Britian Office Action dated Aug. 18, 2021 for GB Application No. 1817381.5, 7 pages.
"CNC Waterjet Cutting", Ibstock Brick Ltd, 1 page.
"The Atrium, Victoria, BC—Project Overview", Precast/Prestressed Concrete Institute, [online], Available from: https://www.pci.org/PCI/Project_Resources/Project_Profile/Project_Profile_Details.aspx?ID=23498 , [Accessed Aug. 12, 2021].
Combined Search and Examination Report dated Mar. 27, 2020 for GB Application No. GB1817381.5, 7 pages.
International Search Report and Written Opinion dated Jan. 30, 2020 for PCT/GB2019/053019, 12 pages.
Wikipedia contributors, Apr. 15, 2018, "Fiber-reinforced concrete", Wikipedia, The Free Encyclopedia [online], Available from: https://en.wikipedia.org/w/index.php?title=Fiber-reinforced_concrete&oldid=836490080 [Accessed Mar. 21, 2022]. 4 pages.
Freyssinet UK, Oct. 12, 2018, "ExoLeaf Ultra-High Performance Concrete", Freyssinet UK, [online], Available from: https://web.archive.org/web/20181012072111/https://freyssinet.co.uk/exoleaf/.
The Great Britain Office Action dated Mar. 24, 2022 for Great Britain Application No. GB1817381.5, a counterpart foreign application of the U.S. Appl. No. 17/281,822, 11 pages.
European Office Action dated Jun. 15, 2023 for European Patent Application No. 19795620.4, a foreign counterpart of U.S. Appl. No. 17/281,822, 6 pages.

* cited by examiner

CLADDING PANEL

CROSS REFERENCE TO RELATED APPLICATIONS

This application is a US national stage entry of International Patent Application No. PCT/GB2019/053019, filed Oct. 23, 2019, which claims priority to GB Patent Application No. 1817381.5, filed Oct. 25, 2018, the entire contents of each of which are incorporated by reference herein.

This invention concerns a cladding panel, and also a method of forming a cladding panel.

Cladding is widely used on buildings to provide an aesthetically pleasing exterior to the building. A wide variety of facing materials can be used to provide a required finish. One type of cladding includes a plurality of facing building members mounted in a required pattern on a cementitious backing layer. The building members are often bricks, though many other types of building members can be used.

With brick facing members, "brick slips" are often used which are relatively thin bricks, which can be formed by cutting conventional bricks for instance into two brick slips. Where bricks are cut this is generally achieved using a diamond tipped saw which inter alia often leaves a layer of dust or slurry upon the cut bricks which can affect their adhesion to the backing layer. Cutting conventional bricks enables any required bricks to be used, such that for instance local bricks can be used to match with existing buildings and structures.

Difficulties can though be encountered in providing a good bond between the brick slips and the cementitious backing layer and also between adjacent brick slips, and especially at the peripheral edges of the cladding where the brick slips may only have two other adjacent brick slips to bond to.

In the specification the term "mechanical key" on a building member is to be understood as a formation which prevents there being a direct line of sight perpendicularly from the rear of a front face of the building member, to a rear of the building member, at any point.

According to a first aspect of the invention there is provided a cladding panel, the panel comprising a plurality of facing building members mounted on a backing of settable material, the facing building members being mounted in rows which are usually aligned horizontally in use, with settable material located in joints between adjacent facing building members in the rows, and settable material located in joints between neighbouring rows of facing building members, the joints between adjacent facing building members in a row are not aligned with the joints between adjacent facing building members in neighbouring rows of facing building members, the facing building members having front faces and a rear side, with recesses being provided in the rear side of at least some of the facing building members in each row, which recesses extend part way into the facing building member and receive settable material, the recesses in facing building members in neighbouring rows being aligned such that one or more columns of settable material in the recesses are provided extending perpendicularly to the rows of facing building members.

Some of the recesses may be provided in ends of the facing building members, and the facing building members may be located adjacent facing building members with recesses in their other ends to produce a larger combined recess.

Some facing building members may include more than one recess.

Some or all of the recesses may be profiled to provide a mechanical key. Some or all of the recesses may diverge towards the facing building member front.

Some or all of the recesses may have a dovetail profile in plan view, which dovetail profile may have rounded edges.

The recesses may be cut in the facing building members rear side with a water jet.

The facing building member may be in the form of a brick facing member, and may be formed by cutting a brick into two or more parts.

The or each recess may extend from between 10 and 60% of the thickness of the facing building member, and more particularly between 25 and 45% of the thickness of the facing building member.

The settable material may be cementitious, may be ultra high performance concrete, which may be fibre reinforced. The fibres may be longer than the thickness of the settable material between neighbouring rows of facing building members.

A continuous layer of settable material may be provided extending across the rear of the cladding panel.

Support areas of extra settable material may be provided on the rear of the cladding panel. The support areas may be in the form of beams of material, which beams may extend parallel to or perpendicular to the rows of facing building members.

The support areas may be provided in locations on the cladding panel where the cladding panel will be mounted on a building or elsewhere.

According to a further aspect of the invention there is provided a method of forming a cladding panel, the method comprising locating a plurality of facing building members which have front faces and a rear side, with recesses being provided in the rear side of at least some of the facing building members, which recesses extend part way into the facing building member, in a pattern of rows with the joints between adjacent facing building members in a row not being aligned with the joints between adjacent facing building members in neighbouring rows, the recesses in the facing building members in neighbouring rows being aligned perpendicularly to the rows of facing building members, locating a settable material onto the rear of the facing building members to fill the recesses, the joints between adjacent facing building members, and the joints between neighbouring rows of facing building members, so as to provide one or more columns of settable materials extending perpendicularly to the rows of facing building members.

Embodiments of the present invention will now be described by way of example only and with reference to the accompanying drawings, in which; —

Figure 1:
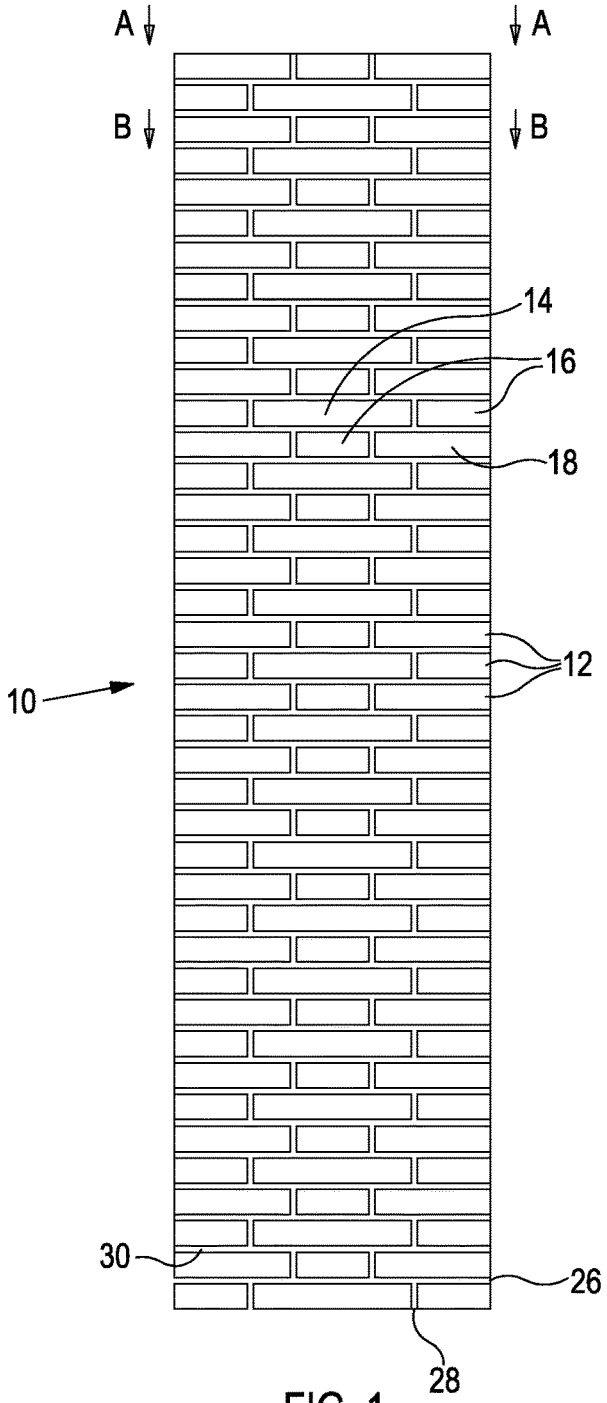
FIG. 1 is a front view of a cladding panel according to the invention.

FIGS. 1 to 9 show a cladding panel 10 formed of rows 12 of brick slips as either full length "stretchers" 14 or half length "headers" 16. In this instance each row 12 includes three brick slips. As can be seen in the centre of adjacent rows 12, alternately stretchers 14 and the headers 16 are provided, with either two part length stretchers 18 either side of a header 16, or two headers 16 either side of a stretcher 14.

Figure 2:
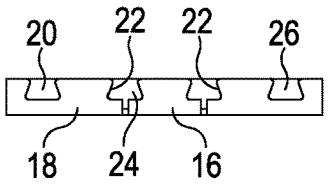
FIG. 2 is a sectional view A-A as shown in FIG. 1.

Profiled recesses 20 are cut into the rear sides of the brick slips. The recesses 20 have a dovetail profile in plan view, with rounded corners. The recesses 20 are cut using a water jet which may include a solid abrasive such as garnet. The dovetail profile provides two mechanical keys, preventing an item being pulled directly out of the recesses 20. In some instances, and as illustrated in FIG. 2, end recesses 22 may be formed in ends of adjacent brick slips to combine to provide a similar recess 24 to that provided wholly within a single brick slip. The location of the recesses 20, 22 in the brick slips are such, taking into account the thickness of the spaces between adjacent brick slips in the rows 12, that the recesses 20, 24 are all vertically aligned.

Figure 3:
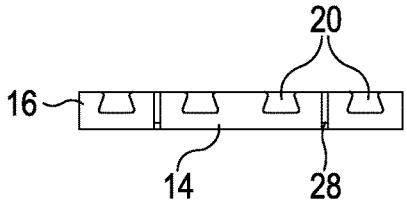
FIG. 3 is a sectional view by B-B as shown in FIG. 1.
Figure 4:
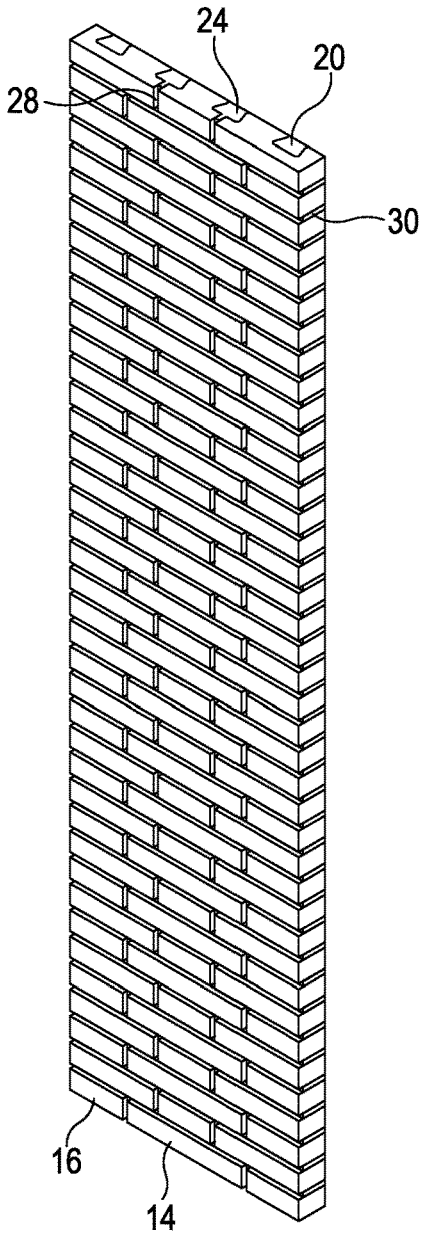
FIG. 4 is a perspective front view of the panel of FIG. 1.
Figure 5:
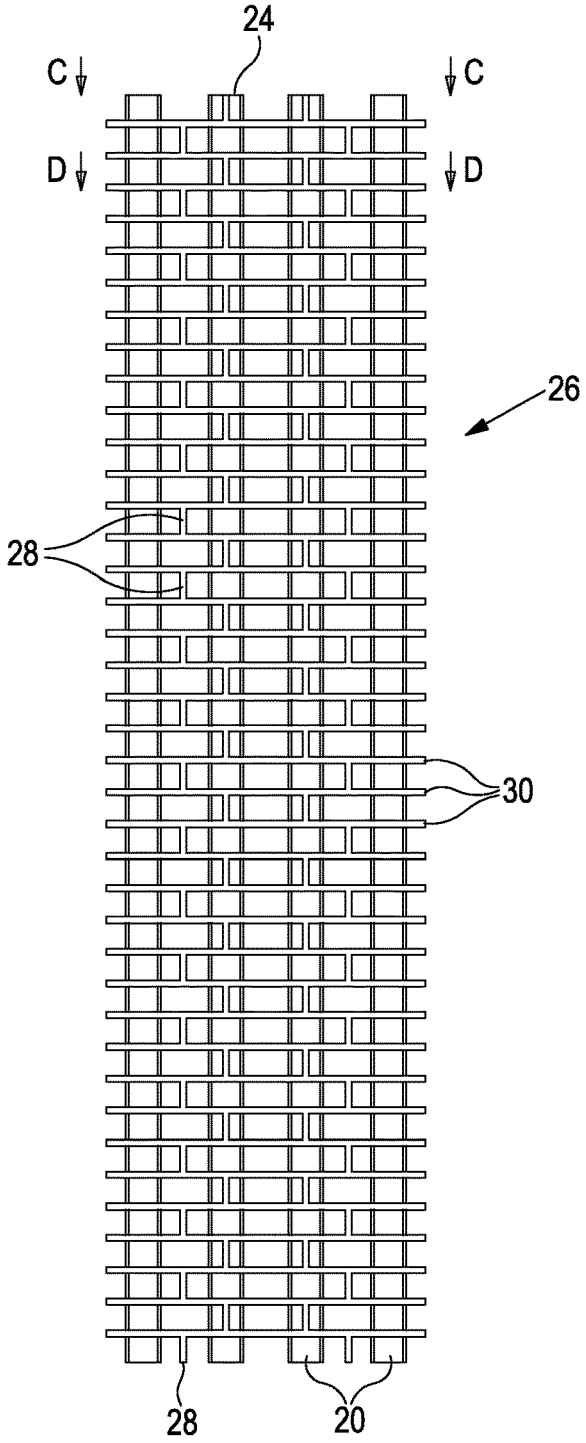
FIG. 5 is a front view of just the settable material in the panel of FIG. 1.

As can be seen in FIG. 2, at this location with the central header 16, a recess 20 is provided in each outer part length stretcher 18, with two central recesses 24 being provided across the joins between the header 16 and the adjacent part length stretchers 18. In the row 12 as illustrated in FIG. 3, two central recesses 20 are provided in the central stretcher 14, with an outer recess 20 being provided in each outer header 16.

The brick slips have a backing of settable material which as illustrated fills the recesses 20, 24 and also the gaps 28 between adjacent brick slips in a row 12, and also the gaps 30 between neighbouring rows 12, one above each other. In this instance the settable material is cementitious, and is ultra high performance concrete (UHPC), which may be fibre reinforced. The fibres may be chosen to be longer than the thickness of the gaps 30 between neighbouring 12 rows of brick slips and also the gaps 28 between adjacent brick slips, such that the fibres will be aligned generally along neighbouring rows 12 and/or perpendicularly thereto between adjacent brick slips.

Figure 6:
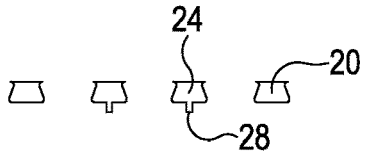
FIG. 6 is a sectional view C-C as shown in FIG. 5.
Figure 7:
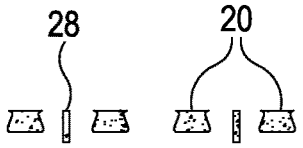
FIG. 7 is a sectional view D-D as shown in FIG. 5.
Figure 8:
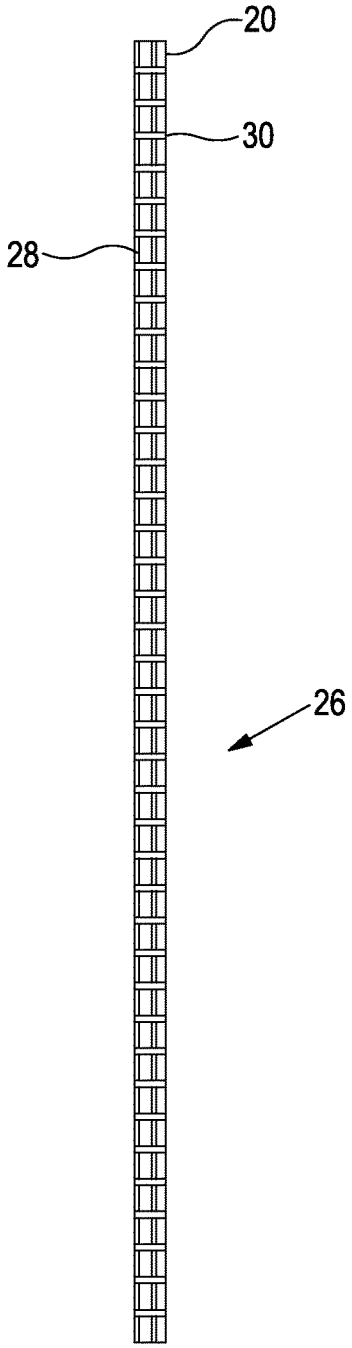
FIG. 8 is a side view of the settable material of FIG. 5.
Figure 9:
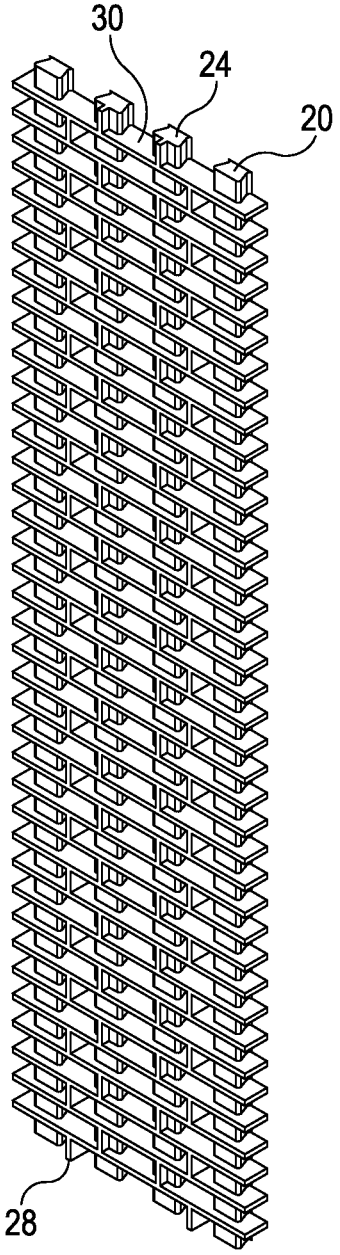
FIG. 9 is a front perspective view of the settable material of FIG. 5.
Figure 10:
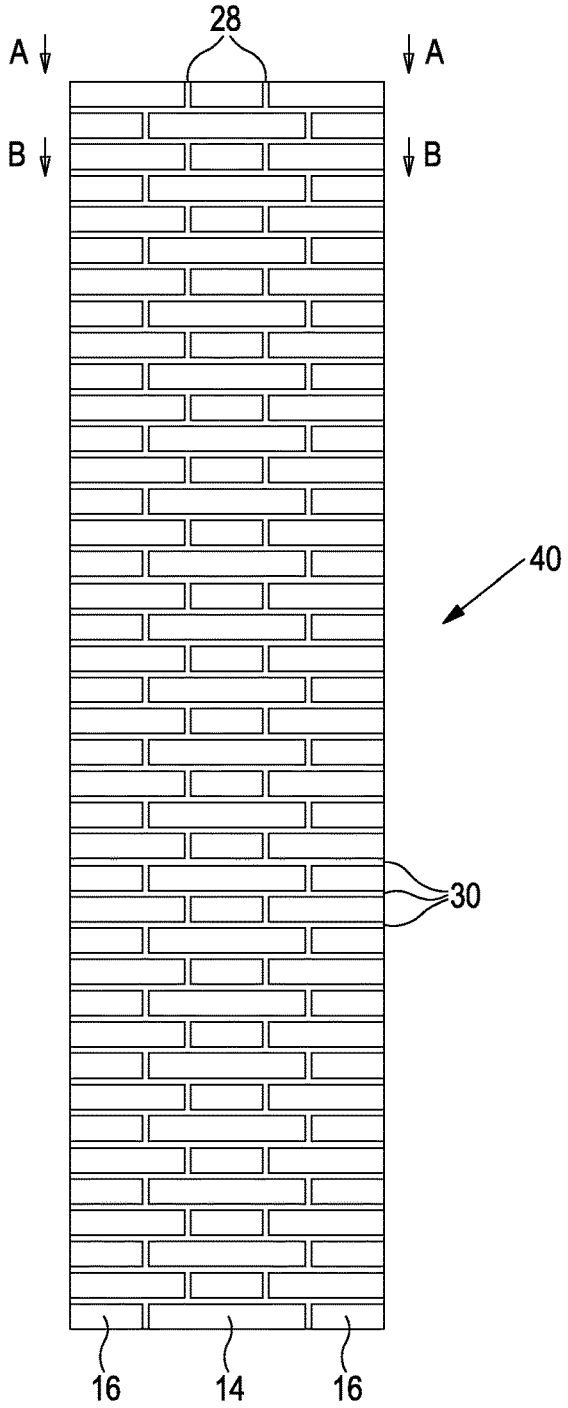
FIGS. 10-18 are respectively similar views to FIGS. 1-9 but of a second cladding panel according to the invention.
Figure 11:
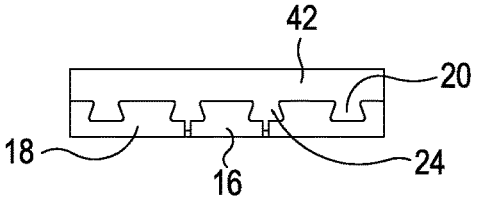
Figure 12:
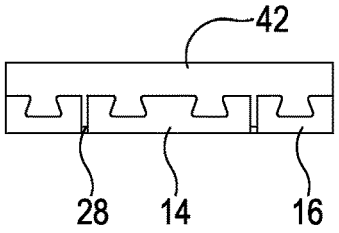
Figure 13:
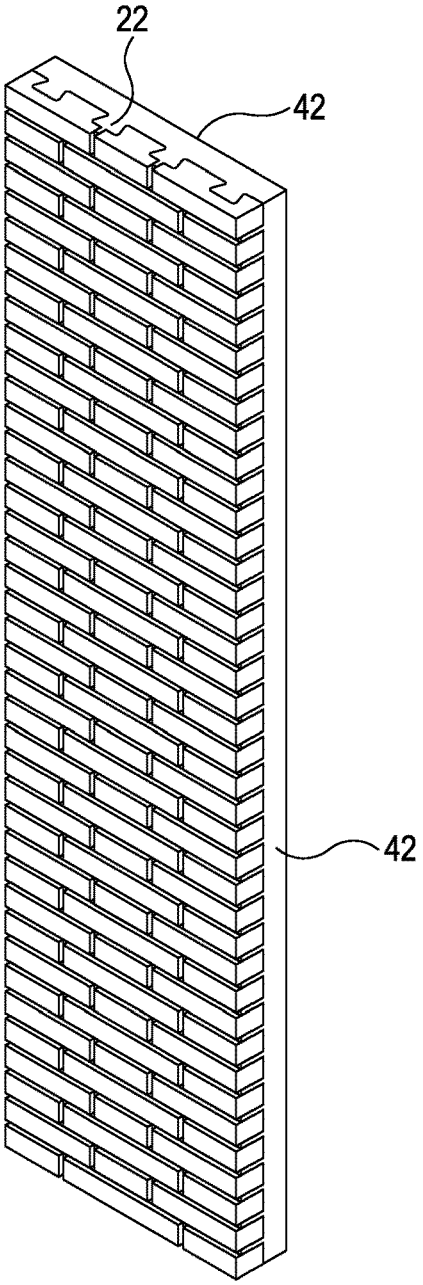
Figure 14:
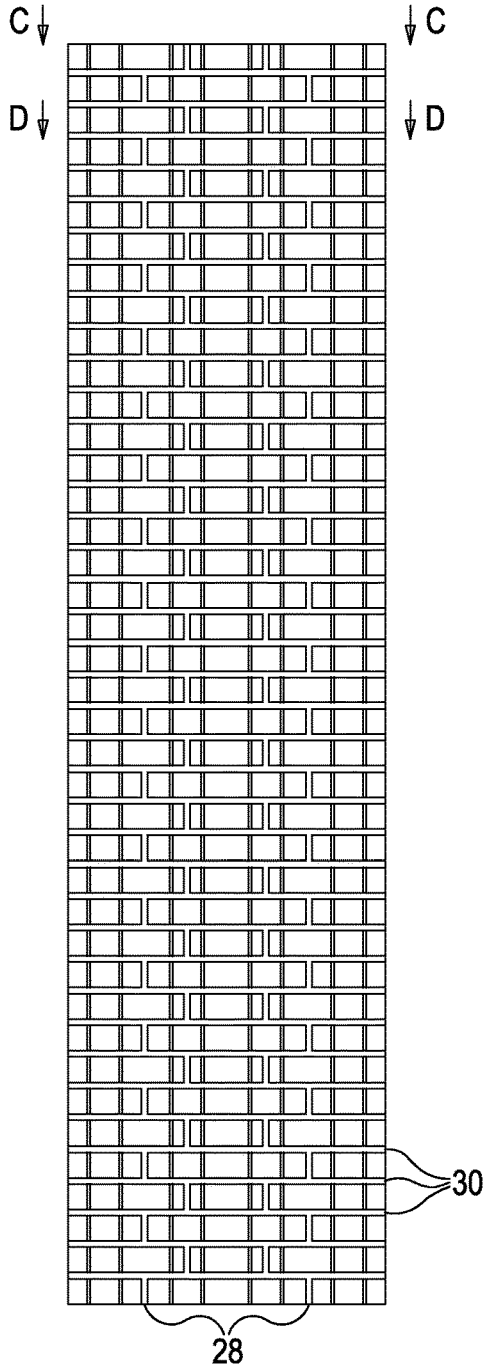
Figure 15:
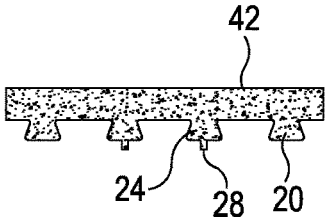
Figure 16:
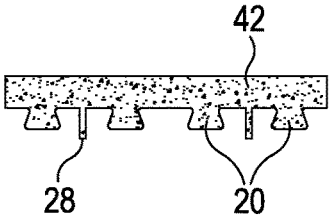
Figure 17:
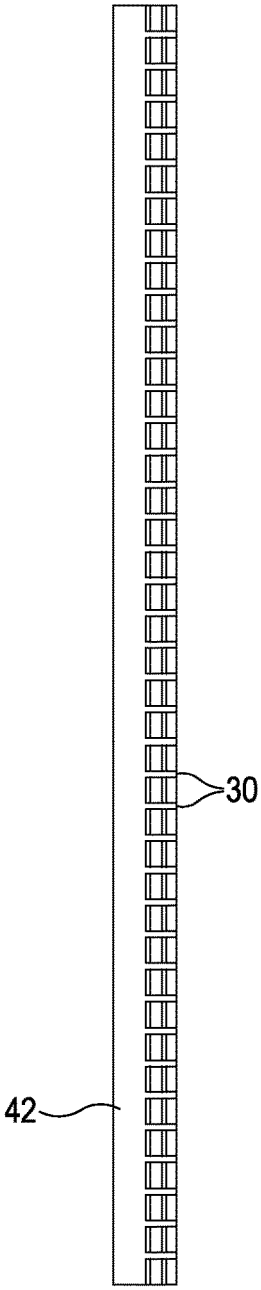
Figure 18:
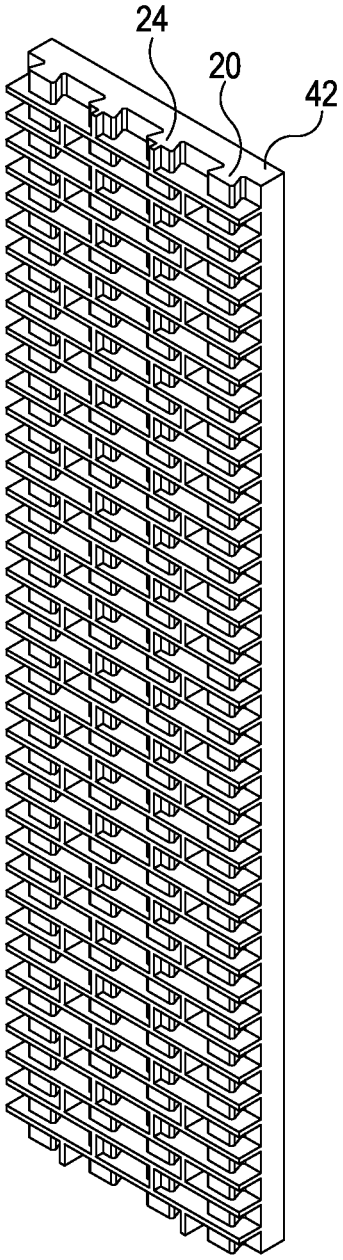
Figure 19:
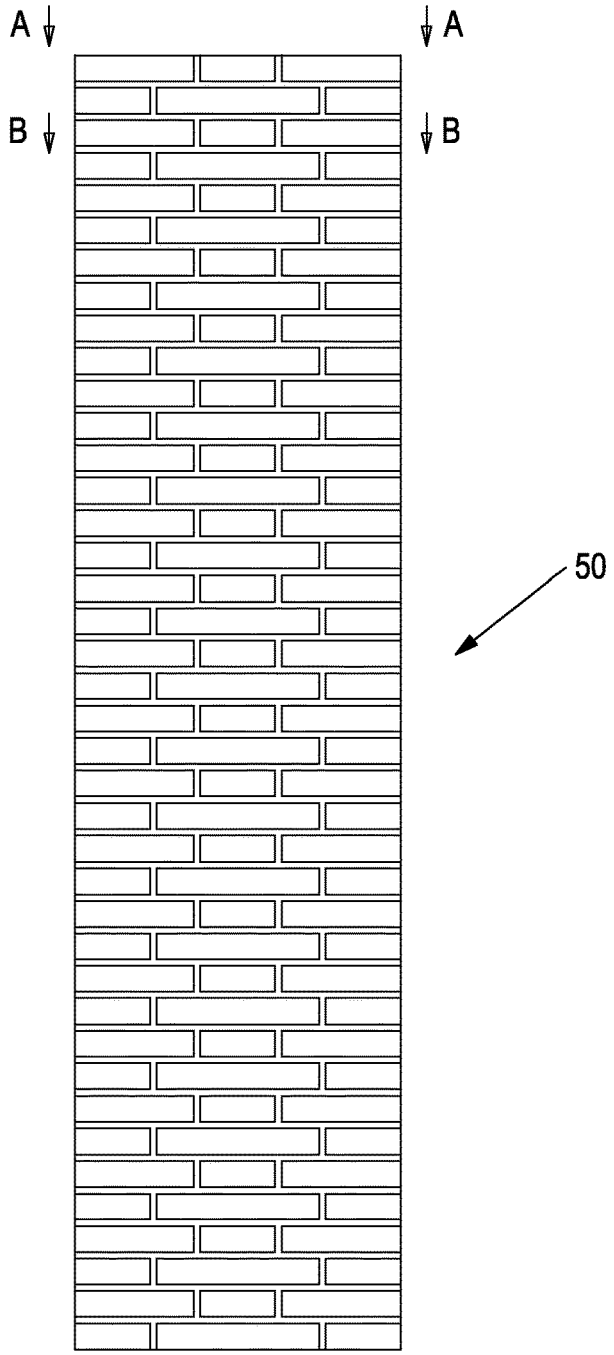
FIGS. 19-27 are respectively similar views to FIGS. 1-9 but of a third cladding panel according to the invention.
Figure 20:
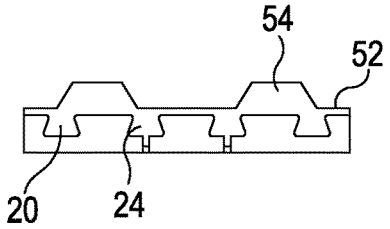
Figure 21:
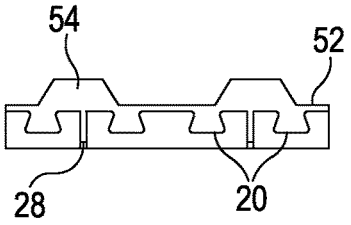
Figure 22:
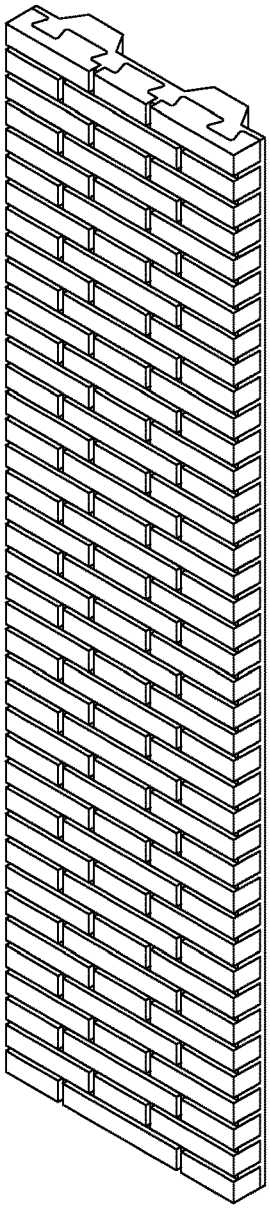
Figure 23:
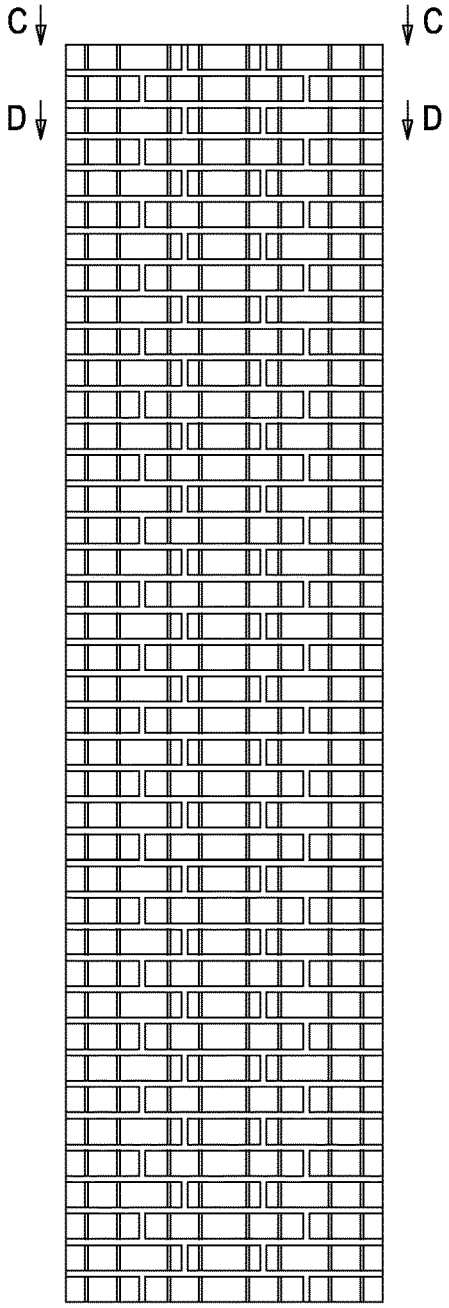
Figure 24:
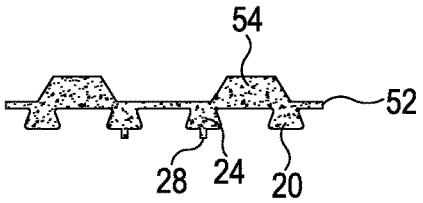
Figure 25:
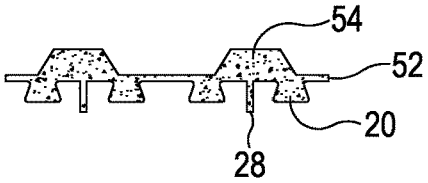
Figure 26:
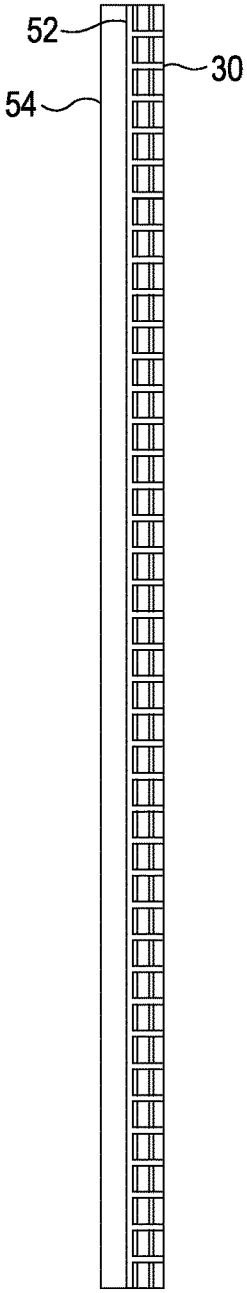
Figure 27:
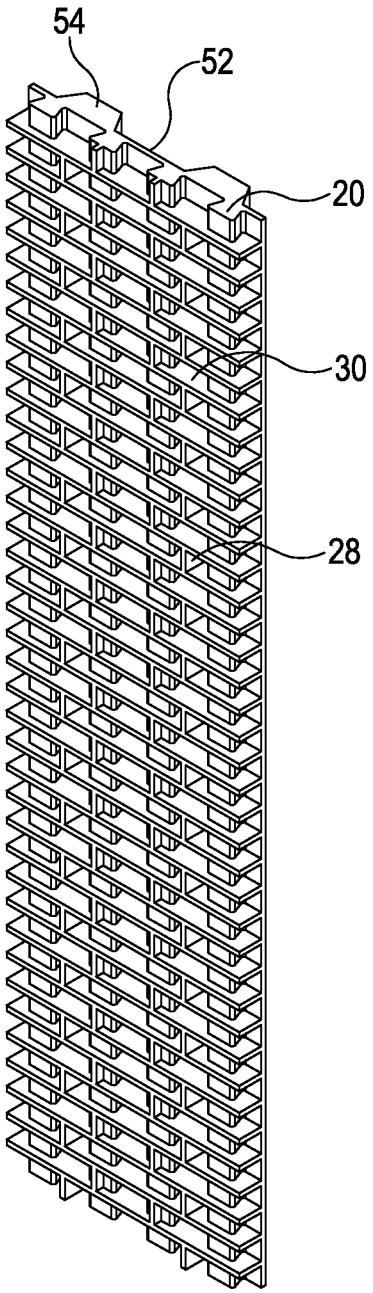
Figure 28:
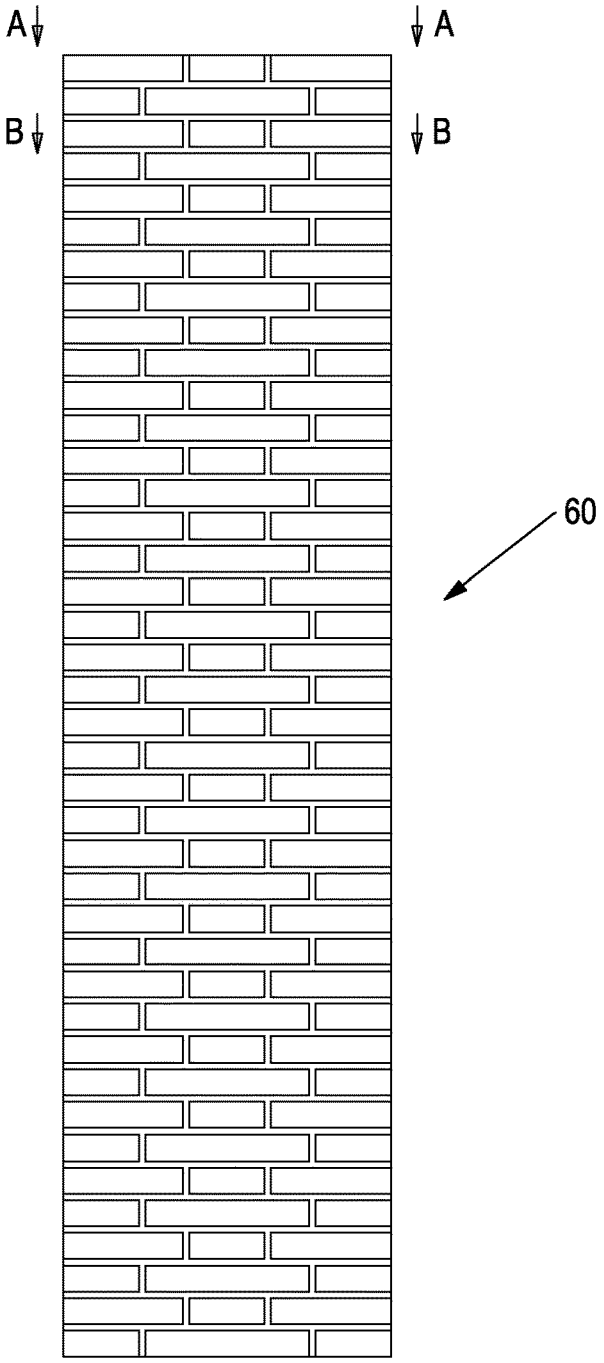
FIGS. 28-36 are respectively similar views to FIGS. 1-9 but of a fourth cladding panel according to the invention.
Figure 29:
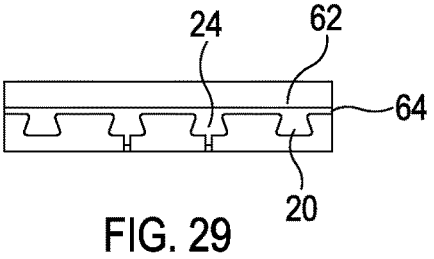
Figure 30:
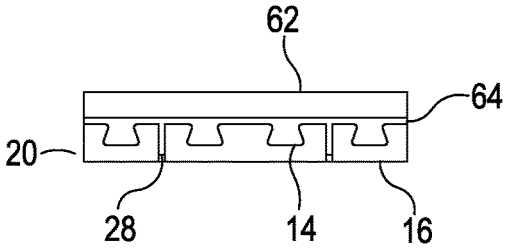
Figure 31:
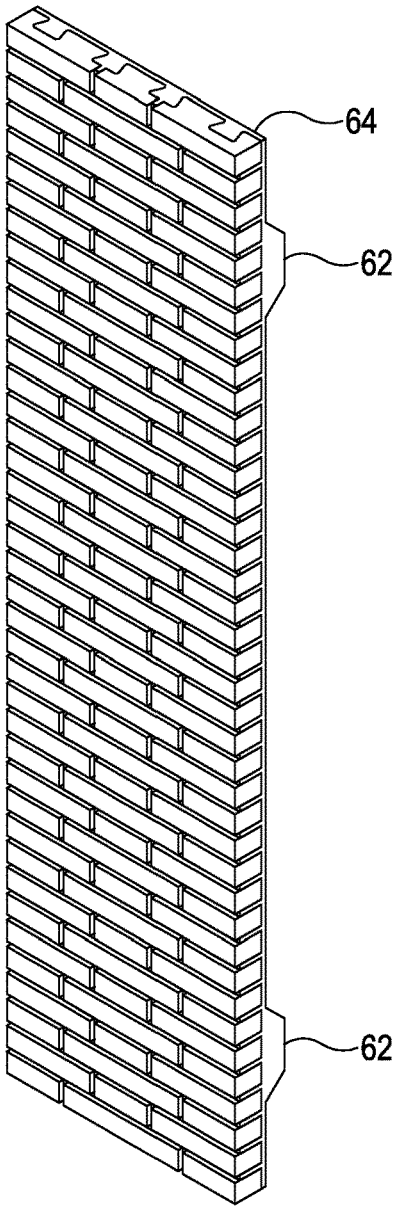
Figure 32:
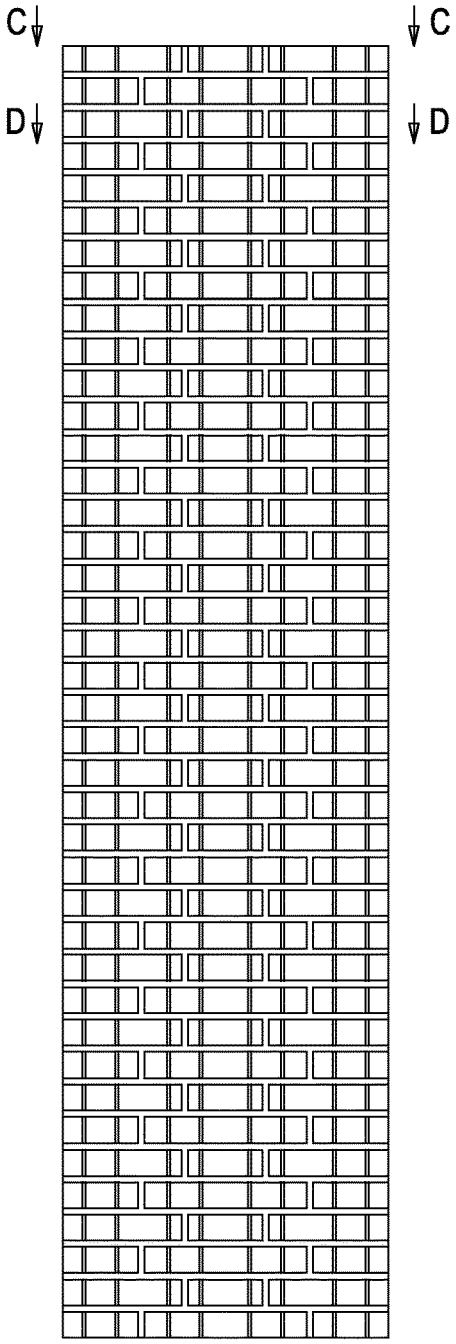
Figure 33:
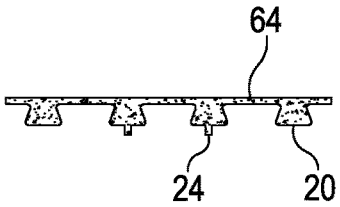
Figure 34:
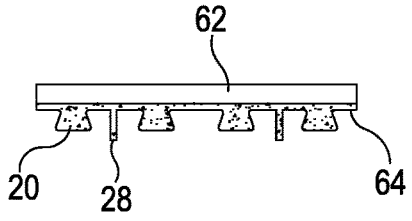
Figure 35:
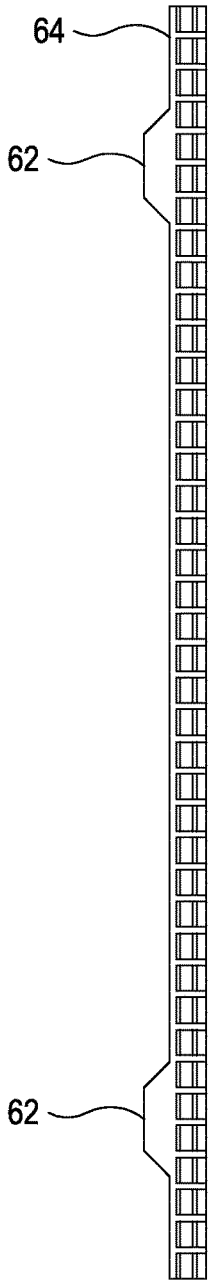
Figure 36:
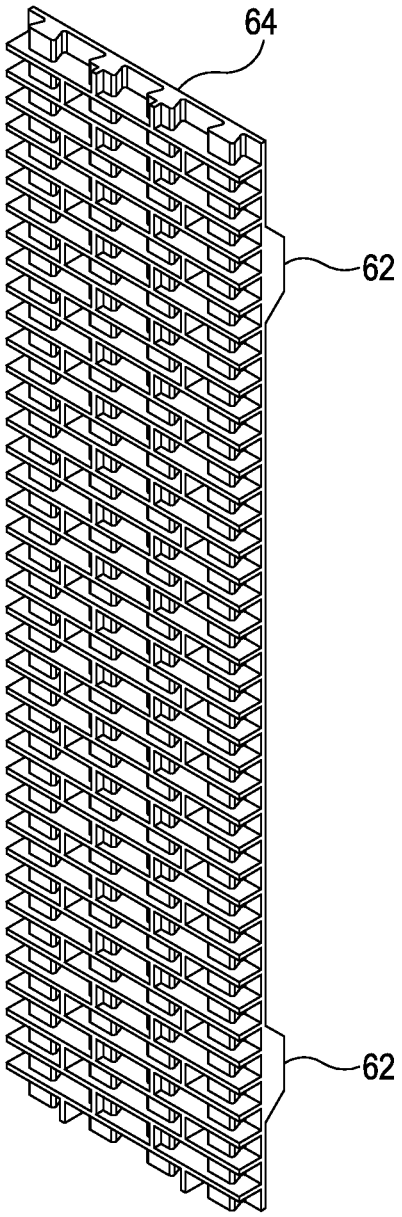
Figure 37:
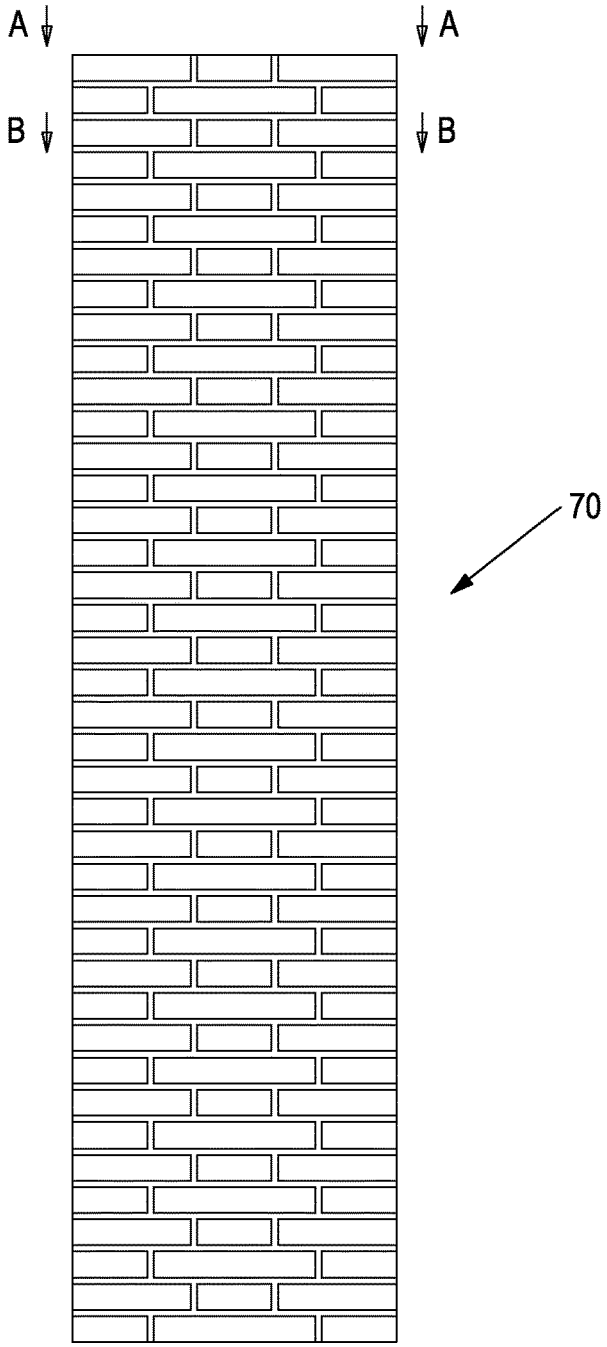
FIGS. 37-45 are respectively similar views to FIGS. 1-9 of a fifth cladding panel according to the invention.
Figure 38:
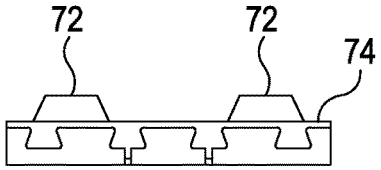
Figure 39:
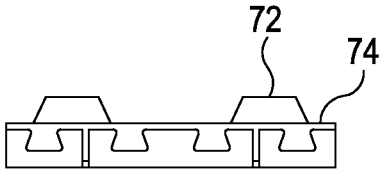
Figure 40:
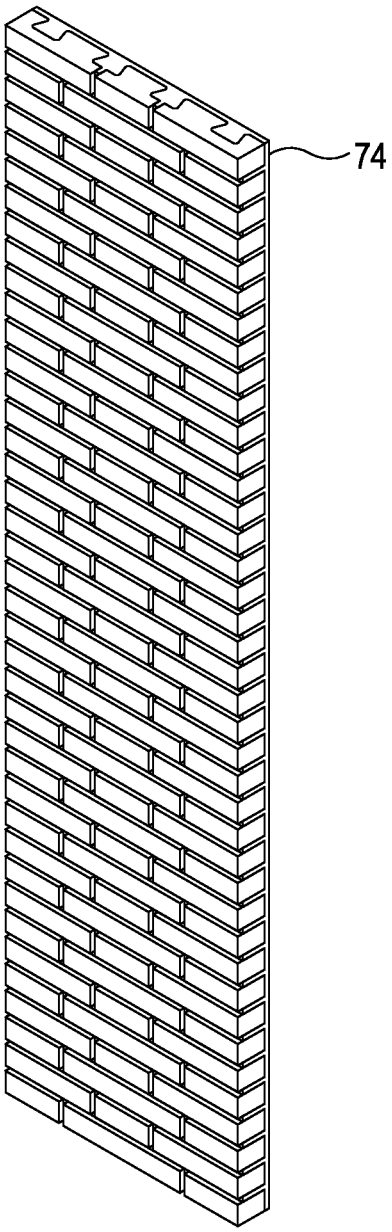
Figure 41:
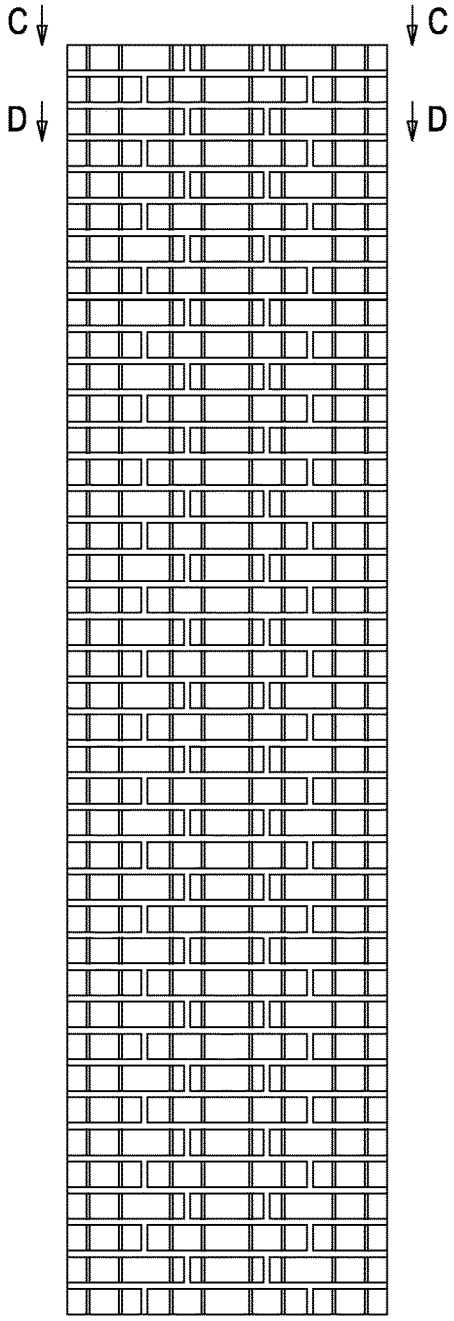
Figure 42:
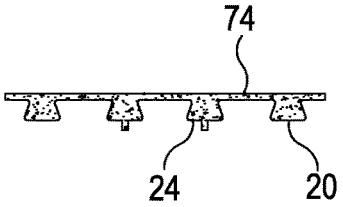
Figure 43:
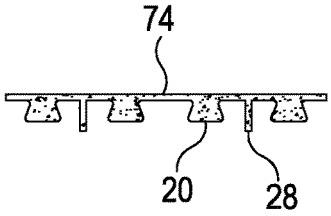
Figure 44:
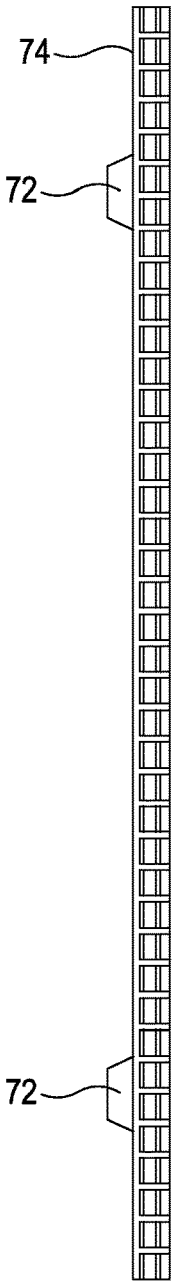
Figure 45:
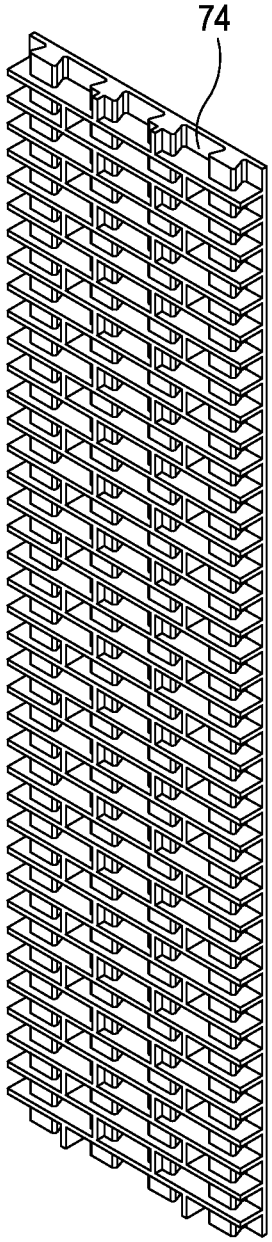
Figure 46:
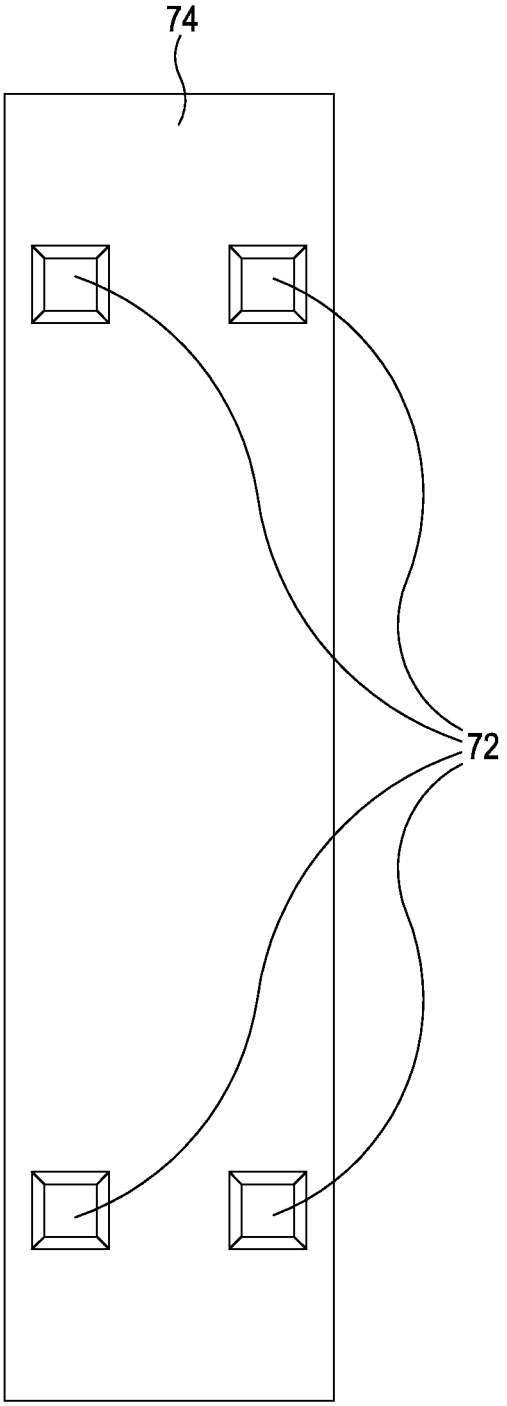
FIG. 46 is a rear view of the cladding panel of FIG. 37.

FIGS. 5 to 9 illustrate the profile of the settable material backing 26, FIG. 6 shows the profile of material filling the recesses 20, 24, with the two central recesses 24 also connecting to the gaps 28 between adjacent brick slips. In FIG. 7 all of the recesses 20 are discrete, with discrete gaps 28 between adjacent brick slips filled with settable material.

In practice the brick slips will be mounted in a mould frame or otherwise and the settable material supplied into the mould frame to locate in the recesses 20, 24 and in the gaps 28, 30 between the rows 12 of brick slips and between adjacent brick slips.

The cladding panel 10 thus formed has a relatively small amount of UHPC, but has the equivalent of vertically extending beams. This is significant in providing strength to the panel 10, as the UHPC has good compressive and flexural strength, whilst the brick slips have essentially no flexural strengths. This therefore provides a relatively strong, slim and lightweight cladding panel.

The second cladding panel 40 shown in FIGS. 10 to 18 is similar to the panel 10 shown in FIG. 1, except that in this instance a complete backing layer 42 of settable material is provided behind the brick slips to provide extra strength and structural support. This extra settable material also enables larger fixings to be cast into the panel.

FIGS. 19 to 27 show a third cladding panel 50 with a relatively thin backing layer 52 of settable material behind the brick slips, but which layer 52 is significantly thinner than the backing layer 42 in the second panel 40. A pair of rearwardly extending vertical beams 54 of settable material are formed on the rear of the backing layer 52, to provide extra strength and structural support in the direction of the beams 54. Larger fixings can be cast into the beams 54.

FIGS. 28 to 36 show a fourth cladding panel 60 which is generally similar to the third cladding panel 50 except that in this instance two horizontally aligned beams 62 are provided on the rear of the backing layer 64 of settable material. Again the beams 62 provide extra strength and structural support in the direction of the beams 62, and permit larger fixings to be cast thereinto.

FIGS. 37 to 46 show a fifth cladding panel 70 which again is similar to the second cladding panel 40, but four extra portions 72 of settable material are provided on the rear of the backing layer 74 to provide extra strength where for instance the cladding panel 70 may be mounted on a building or elsewhere, and to permit larger fixings to be cast into the extra portions 72.

In all of the panels 10, 40, 50, 60, 70 vertically extending beams of the relatively high strength settable material are formed, thereby providing significant strength to the panels without providing excessive thicknesses of settable material which otherwise would increase cost and weight.

Various other modifications may be made without departing from the scope of the invention. For instance different materials could be used for the building facing materials, or for instance for the settable materials. Different formations or other profiles could be formed of the settable material as required. Obviously the panels can extend for a greater width and/or height, than is shown diagrammatically in the drawings.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A cladding panel, the panel comprising:

a plurality of facing building members mounted on a backing of settable material, the facing building members being mounted in rows which are aligned horizontally in use, with settable material located in joints between adjacent facing building members in the rows, and settable material located in joints between neighbouring rows of facing building members, wherein the joints between adjacent facing building members in a row are not aligned with the joints between adjacent facing building members in neighbouring rows of facing building members, the facing building members having front faces and a rear side, with recesses being provided in the rear side of at least some of the facing building members in each row, which recesses extend part way into the facing building member and receive settable material, the recesses in facing building members in neighbouring rows being aligned such that one or more columns of settable material in the recesses are provided extending perpendicularly to the rows of facing building members, wherein some of the recesses are provided in ends of the facing building members at the rear side, located adjacent facing building members with recesses in their other ends at the rear side, to produce larger combined recesses each profiled to provide a dovetail profile, the larger combined recesses being at the joints between adjacent facing building members in the rows, and the larger combined recesses being part of said one or more columns, wherein support areas of extra settable material are provided on a rear of the cladding panel, and wherein the support areas of extra settable material are located to an opposite, rear side of the backing of settable material than a recess-facing side of the backing of settable material filling the recesses, and wherein the backing of settable material is cementitious, including the settable material in the one or more columns and the extra settable material.

2. A cladding panel as claimed in claim 1, wherein some facing building members include more than one recess.

3. A cladding panel as claimed in claim 1, wherein some or all of the recesses are profiled to provide a mechanical key.

4. A cladding panel as claimed in claim 1, wherein some or all of the recesses diverge towards the facing building member front.

5. A cladding panel as claimed in claim 1, wherein some or all of the recesses have a dovetail profile in plan view.

6. A cladding panel as claimed in claim 5, wherein the dovetail profile has rounded edges.

7. A cladding panel as claimed in claim 1, wherein the facing building member is in a form of a brick facing member.

8. A cladding panel as claimed in claim 7, wherein the facing building member is formed by cutting a brick into two or more parts.

9. A cladding panel as claimed in claim 1, wherein the settable material is cementitious.

10. A cladding panel as claimed in claim 1, wherein the settable material is ultra high performance concrete, wherein the ultra high performance concrete is fibre reinforced.

11. A cladding panel as claimed in claim 10, wherein fibres of the ultra high performance concrete that is fibre reinforced are longer than a thickness of the settable material between neighbouring rows of facing building members.

12. A cladding panel as claimed in claim 1, wherein a continuous layer of settable material is provided extending across a rear of the cladding panel.

13. A cladding panel as claimed in claim 1, wherein the support areas are in a form of beams of material.

14. A cladding panel as claimed in claim 13, wherein the beams extend parallel to or perpendicular to the rows of facing building members.

15. A cladding panel as claimed in claim 1, wherein the support areas are provided in locations on the cladding panel where the cladding panel will be mounted on a building or elsewhere.

16. A method of forming a cladding panel, the method comprising:

locating a plurality of facing building members which have front faces and a rear side, with recesses being provided in the rear side of at least some of the facing building members, which recesses extend part way into the facing building member, the facing building members being located in a pattern of rows with the joints between adjacent facing building members in a row not being aligned with the joints between adjacent facing building members in neighbouring rows, the recesses in the facing building members in neighbouring rows being aligned perpendicularly to the rows of facing building members; and locating a backing of a settable material onto the rear of the facing building members to fill the recesses, the joints between adjacent facing building members, and the joints between neighbouring rows of facing building members, so as to provide one or more columns of settable material extending perpendicularly to the rows of facing building members, wherein some of the recesses are provided in ends of the facing building members at the rear side, located adjacent facing building members with recesses in their other ends at the rear side, to produce larger combined recesses each profiled to provide a dovetail profile, the larger combined recesses being at the joints between adjacent facing building members in the rows, and the larger combined recesses being part of said one or more columns, wherein support areas of extra settable material are provided on a rear of the cladding panel, and wherein the support areas of extra settable material are located to an opposite, rear side of the backing of settable material than a recess-facing side of the backing of settable material filling the recesses, and wherein the backing of settable material is cementitious, including the settable material in the one or more columns and the extra settable material.

17. A cladding panel as claimed in claim 1, wherein the or each recess extends from between 10 and 60% of the thickness of the facing building member.

18. A method as claimed in claim 16, wherein the recesses are cut in the facing building members rear side with a water jet.

19. A cladding panel as claimed in claim 1, wherein some of the recesses provide dovetail profiles wholly within single facing building members, wherein at least a first one of the columns fills a first one of the larger combined recesses in a first row of the facing building members, and at least partially fills the joint between adjacent facing building members associated with the first larger combined recess, and wherein the first column comprises one of the dovetail profiles wholly within single facing building members, in a second row of the facing building members, the second row neighbouring the first row.

20. A cladding panel, the panel comprising:

a plurality of facing building members mounted on a backing of settable material, the facing building members being mounted in rows which are aligned horizontally in use, with settable material located in joints between adjacent facing building members in the rows, and settable material located in joints between neighbouring rows of facing building members, wherein the joints between adjacent facing building members in a row are not aligned with the joints between adjacent facing building members in neighbouring rows of facing building members, the facing building members having front faces and a rear side, with recesses being provided in the rear side of at least some of the facing building members in each row, which recesses extend part way into the facing building member and receive settable material, the recesses in facing building members in neighbouring rows being aligned such that one or more columns of settable material in the recesses are provided extending perpendicularly to the rows of facing building members, wherein some of the recesses are provided in ends of the facing building members at the rear side, located adjacent facing building members with recesses in their other ends at the rear side, to produce larger combined recesses each profiled to provide a dovetail profile, the larger combined recesses being at the joints between adjacent facing building members in the rows, and the larger combined recesses being part of said one or more columns, wherein support areas of extra settable material are provided on a rear of the cladding panel, and wherein the support areas of extra settable material are cementitious, and wherein the backing of settable material is cementitious, including the settable material in the one or more columns and the extra settable material.

* * * * *